US007624934B2

(12) United States Patent
Breedlove et al.

(10) Patent No.: US 7,624,934 B2
(45) Date of Patent: Dec. 1, 2009

(54) WIND RESISTANT OSCILLATING SPRINKLER

(75) Inventors: Michael G. Breedlove, Hanna City, IL (US); Lawrence P Heren, East Peoria, IL (US); Scott W. Jacobs, Peoria, IL (US)

(73) Assignee: Robert Bosch Tool Corporation, Mount Prospect, IL (US)

( * ) Notice: Subject to any disclaimer, the term of this patent is extended or adjusted under 35 U.S.C. 154(b) by 0 days.

(21) Appl. No.: 11/345,644

(22) Filed: Feb. 1, 2006

(65) Prior Publication Data

US 2006/0192030 A1 Aug. 31, 2006

Related U.S. Application Data

(60) Provisional application No. 60/649,388, filed on Feb. 2, 2005.

(51) Int. Cl.
*B05B 3/16* (2006.01)

(52) U.S. Cl. ..... 239/242; 239/562; 239/246; 239/257; 239/DIG. 1; 239/581.1; 251/207

(58) Field of Classification Search ..... 239/242, 239/246, 248, 255, 257, 581.1, 581.2, 582.1, 239/101, 541, DIG. 1; 251/209
See application file for complete search history.

(56) References Cited

U.S. PATENT DOCUMENTS

| | | | | |
|---|---|---|---|---|
| 2,693,390 | A * | 11/1954 | Spender et al. | 239/97 |
| 2,942,789 | A * | 6/1960 | Smith | 239/239 |
| 3,647,140 | A | 3/1972 | Perrot et al. | |
| 4,632,313 | A | 12/1986 | Rinkewich | |
| 4,860,954 | A * | 8/1989 | Allemann | 239/101 |
| 5,033,678 | A * | 7/1991 | Borghese et al. | 239/242 |
| 5,098,020 | A | 3/1992 | Cooper et al. | |
| 5,305,956 | A | 4/1994 | Wang | |
| 5,350,115 | A | 9/1994 | Burnworth et al. | |
| 5,402,827 | A * | 4/1995 | Gonzalez | 137/625.17 |
| 5,511,727 | A | 4/1996 | Heren et al. | |
| 5,524,822 | A * | 6/1996 | Simmons | 239/17 |
| 5,628,458 | A * | 5/1997 | Kuo | 239/242 |
| 5,645,218 | A | 7/1997 | Heren et al. | |
| 5,730,366 | A | 3/1998 | DeWitt | |
| 5,938,122 | A | 8/1999 | Heren et al. | |
| 6,062,490 | A * | 5/2000 | Katzer et al. | 239/246 |
| 6,085,995 | A | 7/2000 | Kah, Jr. et al. | |
| 6,601,781 | B2 | 8/2003 | Kah, III et al. | |
| 2002/0092931 | A1 | 7/2002 | Coote | |
| 2003/0010842 | A1 | 1/2003 | Kah, Jr. | |

FOREIGN PATENT DOCUMENTS

| | | | |
|---|---|---|---|
| EP | 0826 427 | A2 | 3/1998 |

* cited by examiner

*Primary Examiner*—Dinh Q Nguyen
(74) *Attorney, Agent, or Firm*—Maginot, Moore & Beck

(57) ABSTRACT

Mechanisms and method of flow control for use in an oscillating sprinkler that varies the water stream height to lessen the adverse effects of wind on the water streams. The flow control mechanism varies water flow during rotation of a spray tube of a sprinkler to control the height of water streams in predetermined portions of the rotation.

20 Claims, 12 Drawing Sheets

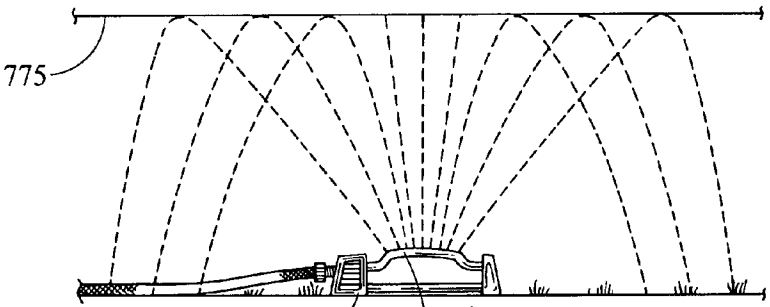
FIG. 7C
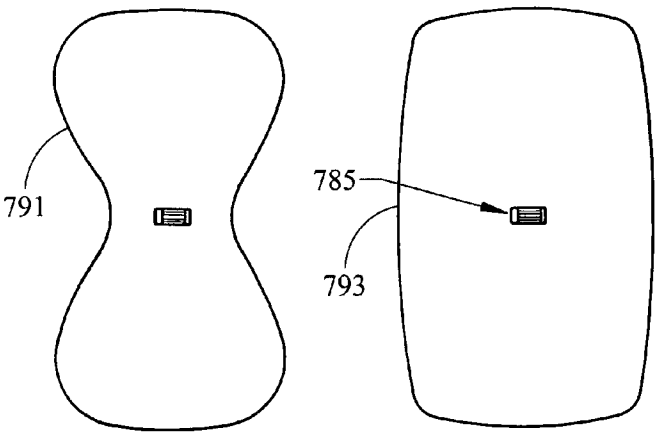
FIG. 7D
FIG. 7E
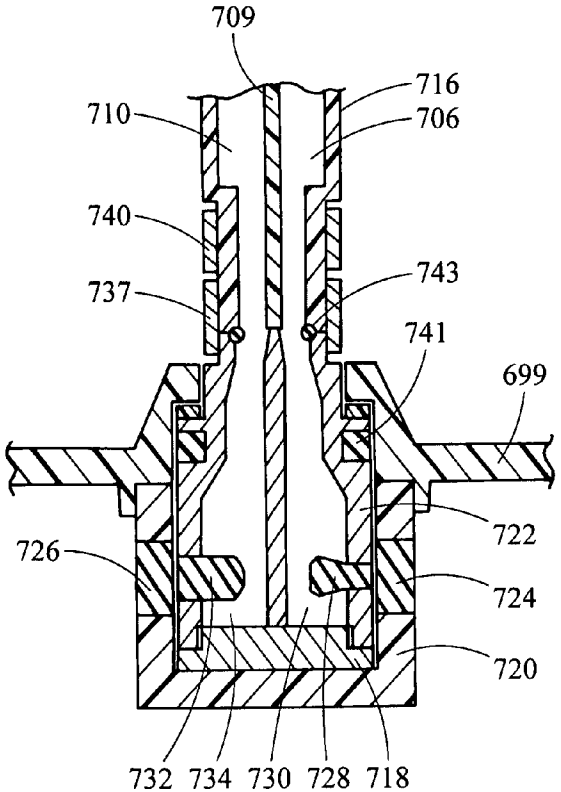
FIG. 7B

WIND RESISTANT OSCILLATING SPRINKLER

CROSS-REFERENCE TO RELATED APPLICATIONS

This application claims priority to U.S. Provisional Application Ser. No. 60/649,388, filed Feb. 2, 2005, which is incorporated herein by reference in its entirety.

FIELD OF INVENTION

The present invention relates generally to the field of oscillating sprinklers for lawn and garden use. More specifically, the present invention is directed to an oscillating sprinkler that varies the water spray height to limit the adverse effects of wind on the water spray.

BACKGROUND OF INVENTION

Most prior art oscillating sprinklers provide a constant water flow to the sprinkler nozzles during the entire stroke of the sprinkler. The typical oscillating sprinkler must produce streams that reach great distances horizontally from the sprinkler in order to water a selected, approximately rectangular, watering area. However, because the water flow to the nozzles is substantially constant during the entire oscillation stroke of the sprinkler, the vertical height of the water streams from the nozzles when the nozzles direct the streams nearly perpendicular to the ground is almost the same distance as the horizontal length reached by the streams. FIGS. 1A-1B show the normal end-view and side-view water stream profiles, respectively, and FIG. 1C shows the watering area pattern, of a typical prior art oscillating sprinkler 100 as the sprinkler arm 106 completes an oscillatory arc. FIG. 1A shows a diagrammatic end view of the watering stream profile. The profile of the "throw" of the water streams (which includes their height and/or length) approximates an arc 102. The height of water streams near the zenith of the arc 102 can be problematic, because even light winds tend to carry a significant portion of the higher streams of water out of the desired spray area (while lower streams of water are affected by wind, they are not carried as far out of the spray area as higher streams). This can increase water waste due to loss by evaporation and often produces an uneven watering area. In addition, water is wasted by being directed to areas that the user does not intend to water. FIG. 1B depicts a side view of a water stream profile 112 when the water streams from the sprinkler arm 106 are vertical. The top portion of this side view of water stream profile 112 also approximates an arc.

FIG. 1C illustrates a top view of a normal watering area pattern—without any wind—of a typical prior art oscillating sprinkler 100 as the sprinkler arm 106 completes an oscillatory arc. The watering area pattern approximates an elongate oval 108. A typical area to be watered (e.g., a garden or yard) is usually more rectangular (e.g., phantom line rectangle 110). As a result, it is desirable to provide a watering pattern that is more rectilinear, thereby directing the water more efficiently to the area a user desires to water rather than dispensing water on "out-of-bounds" areas or leaving corners of a rectangular area unwatered.

U.S. Pat. No. 4,860,954 (the '954 Patent) discloses an oscillating sprinkler with a throttling mechanism provided to cyclically throttle the water flow to the nozzles to provide an aesthetically pleasing undulating spray pattern of the water streams. However, the '954 Patent does not systematically throttle water streams based upon their angle to or height from the ground in a manner that addresses the problem caused by winds carrying high water streams out of the desired spray area.

Thus, there is a need for an oscillating sprinkler that is capable of emitting water streams that effectively water a desired watering spray area, but that have a controlled vertical height, thereby reducing or minimizing undesirable effects caused by wind.

SUMMARY OF THE INVENTION

These needs and others may be met in various embodiments of the present invention. Additional advantages of the invention will be realized and attained by the invention as particularly pointed out in the written description and claims hereof, as well as from the appended drawings.

In one aspect, the invention includes an oscillating sprinkler that comprises an inlet and an elongate water dispensing body. The elongate water dispensing body is configured for dispensing water streams through a plurality of outlets, and is configured to rotate back and forth about its longitudinal axis such that movement of the plurality of outlets defines an oscillatory arc (which arc includes a middle and two ends). The sprinkler also includes at least one valve mechanism disposed between the inlet and the plurality of outlets. The valve mechanism provides for a decreased water flow to at least a portion of the water streams when the plurality of outlets is near at least one predetermined portion of the oscillatory arc.

It is to be understood that both the foregoing brief description and the following detailed description are not limiting but are intended to provide further explanation of the invention claimed. The accompanying drawings, which are incorporated in and constitute part of this specification, are included to illustrate and provide a further understanding of the method and system of the invention, which is defined by the claims.

BRIEF DESCRIPTION OF DRAWINGS

FIGS. 7A-7B picture an embodiment of flow control mechanism with a dual-lumen spray tube according to the present invention;

FIG. 7C shows a side view of a water stream profile from a sprinkler using an embodiment according to the present invention;

FIGS. 7D-7E show top views of watering area patterns;

DETAILED DESCRIPTION

Figure 2:
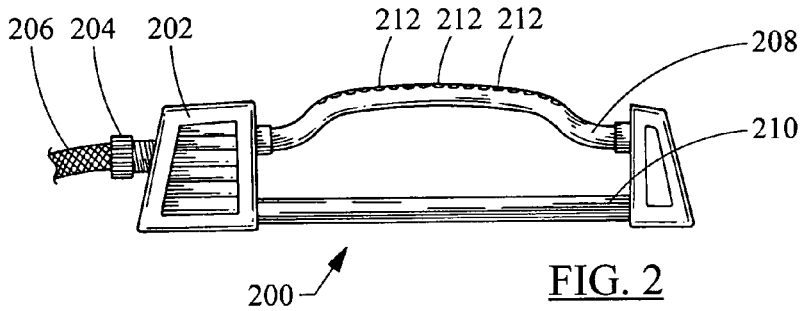
FIG. 2 is a side view of an oscillating sprinkler using an embodiment of a flow controller according to the present invention.

Referring now to the drawings, FIG. 2 shows one embodiment of an oscillating sprinkler 200 according to the present invention. The sprinkler 200 includes a housing 202 with an inlet connector 204 configured for connection to a hose 206, which provides water to the sprinkler. The housing 202 contains a water-impelled oscillator mechanism (not shown) for rotating a spray tube 208, which includes a plurality of nozzles 212 for dispensing streams of water. Water is directed through a predetermined path in the housing 202 to the spray tube 208. During a typical watering cycle, the spray tube 208 rotates back and forth (i.e., oscillates) approximately 90 degrees about its longitudinal axis. Specifically, as the spray tube 208 rotates back and forth, the nozzles 212 travel about 45 degrees to either side of vertical. Thus, the nozzles 212 move back and forth in an oscillatory arc or stroke over successive watering cycles. In some applications, this range of rotation may be increased or decreased by a user (e.g., by adjusting the sprinkler 200 such that the nozzles 212 move only 35 degrees in either direction from vertical, or adjusting them such that they move between vertical and 55 degrees from vertical in one direction only). A base 210 is attached to the housing 202 and supports the spray tube 208. The spray tube 208 is illustrated as being curved, but may be straight or some other shape in alternative embodiments. The exterior appearance of the sprinkler 200 may not differ significantly from existing sprinkler models, which presents one advantage of the present invention: certain embodiments of the present invention may be retrofit to an existing sprinkler model, offering efficiencies of scale and tooling in manufacture.

Figure 3:
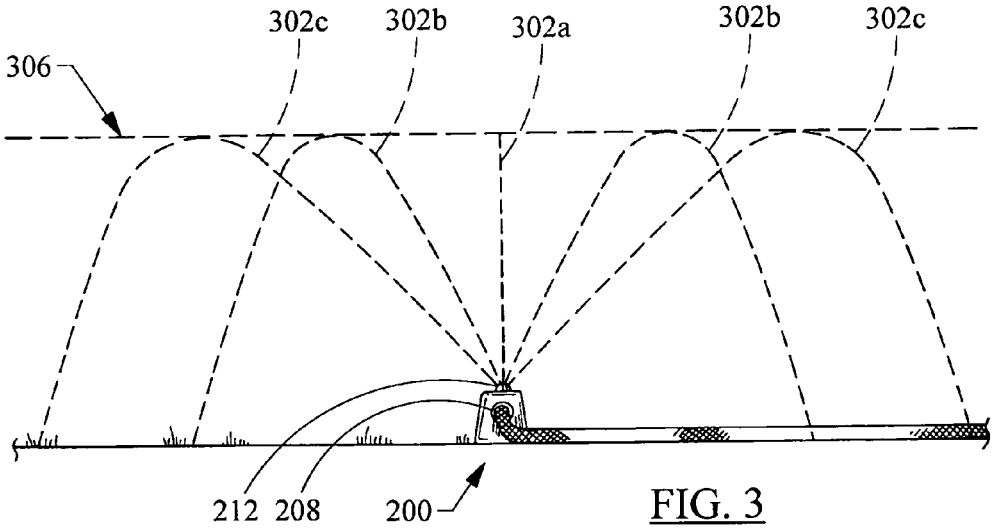
FIG. 3 is an end view of the oscillating sprinkler of FIG. 2 and illustrates an end view of a water stream profile, depicting water streams at various points of the sprinkler's oscillation.

FIG. 3 shows an end profile of water streams 302*a-c* dispensed at exemplary points of a watering cycle from the nozzles 212 in the oscillating sprinkler 200. Various embodiments of mechanisms used to control water flow to achieve a watering stream profile similar to that illustrated in FIG. 3 are described in conjunction with later figures. When the nozzles 212 are at about a 45 degree angle, the water streams 302*c* are at about a full flow. When the nozzles 212 are at this angle, the height of the water streams 302*c* is less than that at which a light wind will significantly affect the streams 302*c*. When the nozzles 212 are pointed at a steeper angle with respect to the ground, the flow of the steeper water streams 302*b* is reduced such that the height of the steeper angled water streams 302*b* does not exceed a predetermined height 306. This predetermined height 306 is less than the height that would be reached by the steeper angled water streams 302*b* if they were at a full water flow, and is preferably a height such that a light wind will not significantly affect the water streams, thereby adversely affecting watering efficiency and the watering area. As the spray tube 208 approaches the zenith of its oscillatory rotation where the nozzles 212 are pointed substantially vertically, approximately perpendicular to the ground, the flow of the substantially vertical water streams 302*a* is reduced even further. Consequently, the height of the substantially vertical water streams 302*a* does not exceed the predetermined height 306. Preferably, the predetermined height 306 is about two to about eighteen feet. Most preferably, the predetermined height 306 is about six to about eight feet. In addition to reducing the effect of wind on water streams, this predetermined height provides a water stream profile that is observably different (from the prior art water stream profile) in the eyes of a user, offering a novel aesthetic visual effect. The height of the water streams during an operation of a sprinkler using the present invention may vary somewhat depending upon the specific flow control mechanism used and upon the flow of water directed by a user through the sprinkler.

Figure 1A:
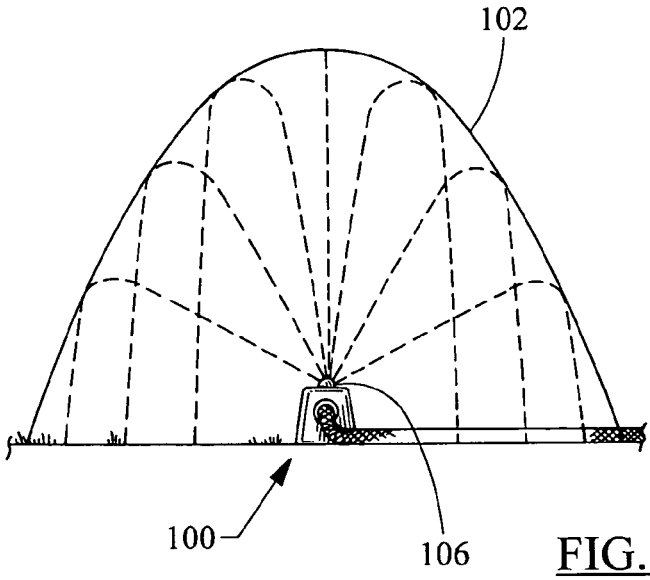
FIG. 1A (Prior Art)
FIG. 1A shows an end view of a water stream profile produced by a typical prior art oscillating sprinkler.
Figure 1B:
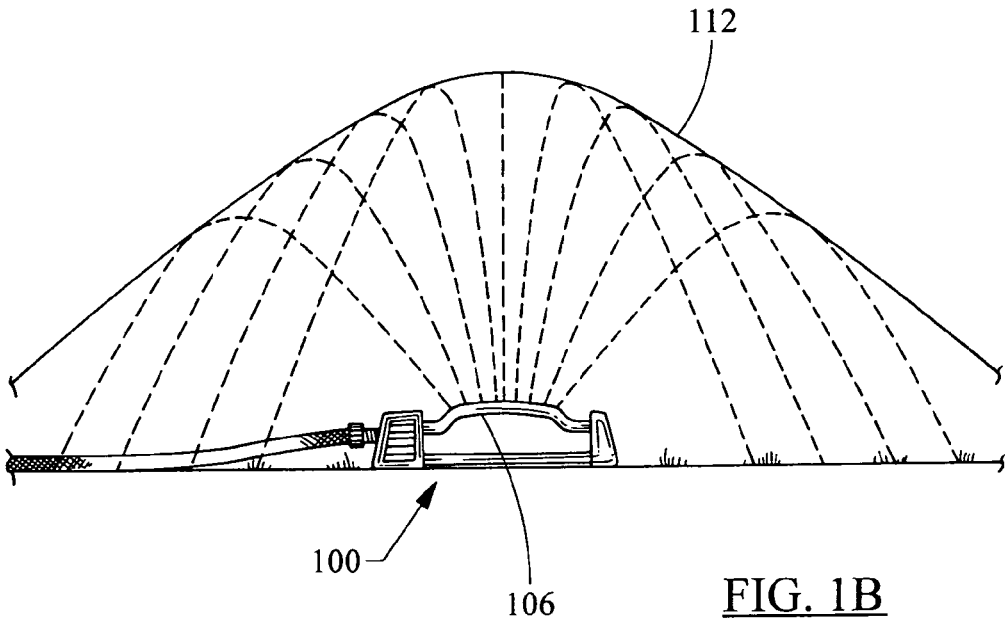
FIG. 1B (Prior Art)
FIG. 1B shows a side view of a water stream profile produced by a typical prior art oscillating sprinkler.
Figure 1C:
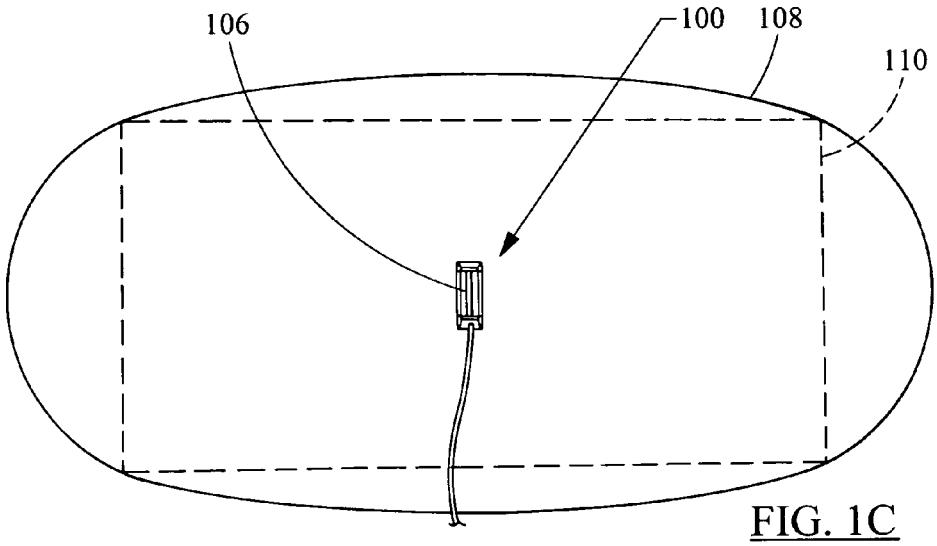
FIG. 1C (Prior Art)
FIG. 1C shows a top view of a watering area pattern produced by a typical prior art oscillating sprinkler.

Generally, a sprinkler using the present invention produces a water stream pattern with a lower vertical profile to reduce the effects of wind on the streams (i.e., the water stream profile preferably has a flatter top portion than the arc 102 viewed from an end and illustrated in FIG. 1A and than the arc 112 viewed from a side and illustrated in FIG. 1B). Preferably, this is accomplished while providing a substantially more rectangular watering spray pattern and a greater watering area than would be obtained if a user simply reduced the water flow from a water supply (e.g., a spigot) to the sprinkler, which would both shorten the streams and decrease the watering area. These features are discussed in more detail below, with reference to FIGS. 7C-7D.

Figure 4:
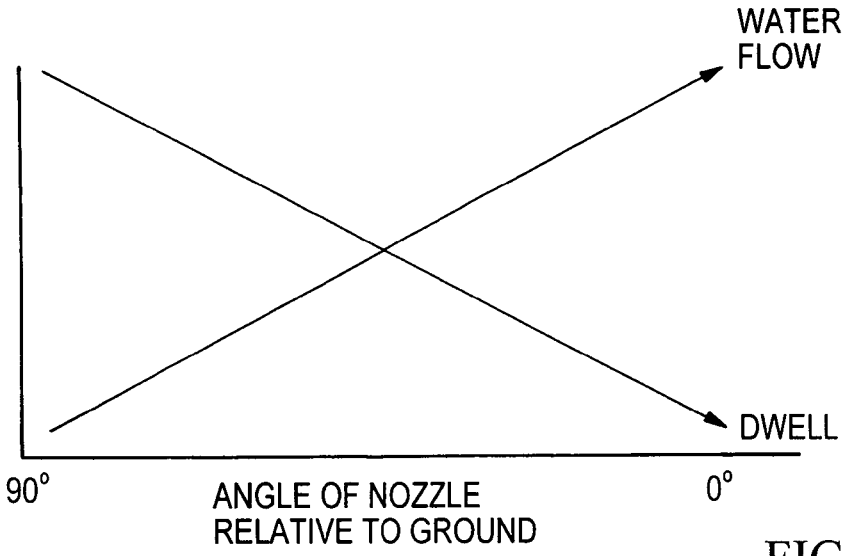
FIG. 4 is a graph showing the dwell time and water flow with respect to the angle of nozzles an oscillating sprinkler according to the present invention.

FIG. 4 shows a graph generally indicating how an oscillating sprinkler using the present invention can achieve substantially uniform water distribution throughout the watering area while the water flow is systematically controlled to vary the height of the water streams. At lower angles with respect to the ground, the water flow to the nozzles is at its greatest level. Viewed along the longitudinal axis of an oscillating sprinkler, as the angle of the nozzles with respect to the ground increases to near 90 degrees (vertical), the water flow to the nozzles is reduced to its lowest level. The dwell time is inversely related to the water flow in order to provide substantially uniform watering throughout the watering area. As less water is being sprayed with a decreased water flow, the oscillation slows to increase the dwell time such that the ground area being watered with the lower water flow streams receives a water quantity similar to that for the ground area being watered with the greater water flow streams.

There are many mechanisms for achieving the desired variation in water flow to the nozzles during the stroke of the spray tube 208. One set of embodiments includes placing a valve arrangement between the inlet 204 and the nozzles 212 on the spray tube 208 of the sprinkler 200 wherein the valve arrangement is configured to provide an increased water flow to the nozzles 212 nearer the ends of an oscillating sprinkler's watering cycle and to provide a decreased water flow to the nozzles 212 nearer the middle of the watering cycle (which preferably provides a water stream end profile similar to that shown in FIG. 3). FIGS. 7A-7B, 8A-8D, 9A-9E, and 10A-10G each depict embodiments that use a flow controller/valve arrangement between the inlet and the outlets of a sprinkler to provide a desired water stream profile.

Figure 5A:
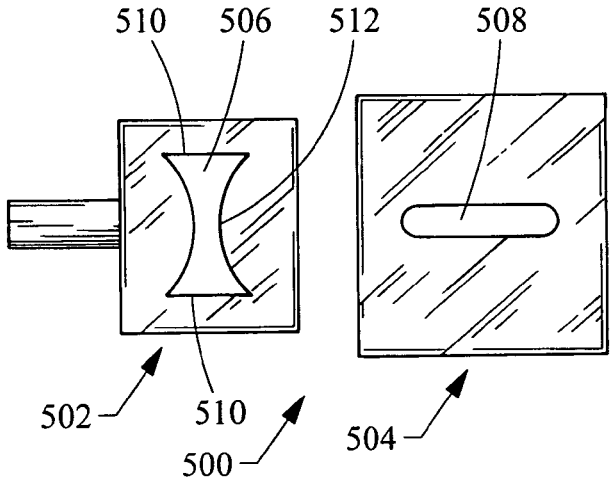
FIGS. 5A-5C show one example of a flow control valve according to the present invention.
Figure 5B:
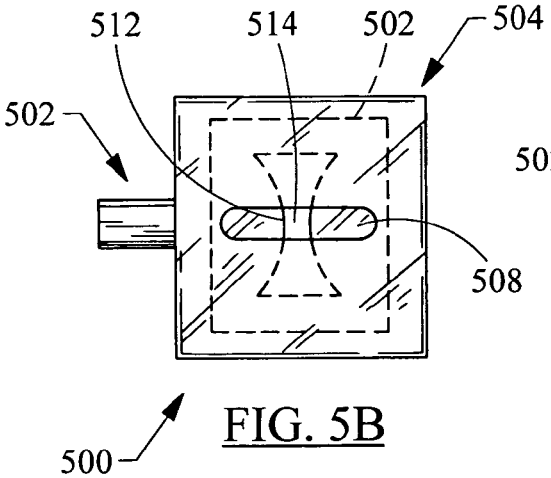
Figure 5C:
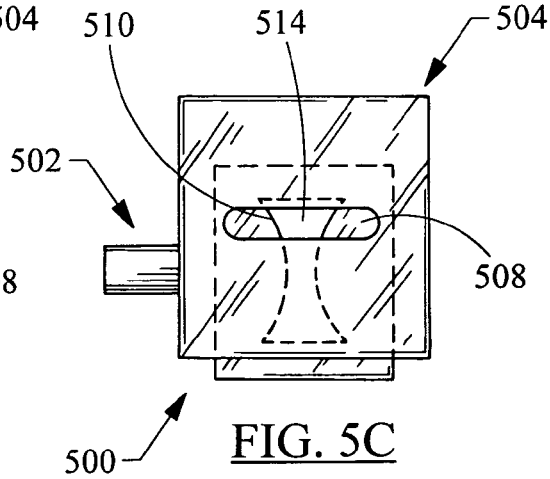

FIGS. 5A-5C illustrate one embodiment of a flow control mechanism of the present invention that uses an hourglass valve arrangement 500 to achieve a water stream profile with a controlled height as described above (with reference to FIG. 3). FIG. 5A shows first and second valve pieces 502, 504. The first valve piece 502 includes an hourglass aperture 506. The hourglass aperture 506 includes wider end portions 510 and a narrower middle portion 512. The second valve piece 504 includes an obround aperture 508. The first valve piece 502 mounts against the second valve piece 504 such that at least a portion of the hourglass aperture 506 movably aligns with the obround aperture 508. The movable alignment is such that at least one of the first and second valve pieces 502, 504 can move relative to the other.

During a watering cycle, the relative alignment of the two apertures 506, 508 changes to control the water flow through the combined aperture 514 created by their overlap. As pictured in FIG. 5B, near the middle of the water cycle (corresponding to the substantially vertical stream 302*a* in FIG. 3), the narrower middle portion 512 of the hourglass aperture 506 is aligned with the obround aperture 508 such that the combined aperture 514 is has its smallest area, thereby decreasing the water flow allowed and resulting in a shorter water stream. As shown in FIG. 5C, near the ends of the water cycle (corresponding to angled water streams 302*c* in FIG. 3), the wider end portion 510 of the hourglass aperture 506 is aligned with the obround aperture 508 such that the combined aperture 514 has a larger area, thereby increasing the water flow allowed and resulting in a water stream. An hourglass is only one of several valve opening shapes useful in various embodiments of the present invention. Other valve opening shapes including others having a narrower middle portion and wider end portions (e.g., a "K-shaped" valve opening, not shown) will be apparent to those skilled in the art as within the scope of the present invention.

Figure 5D:
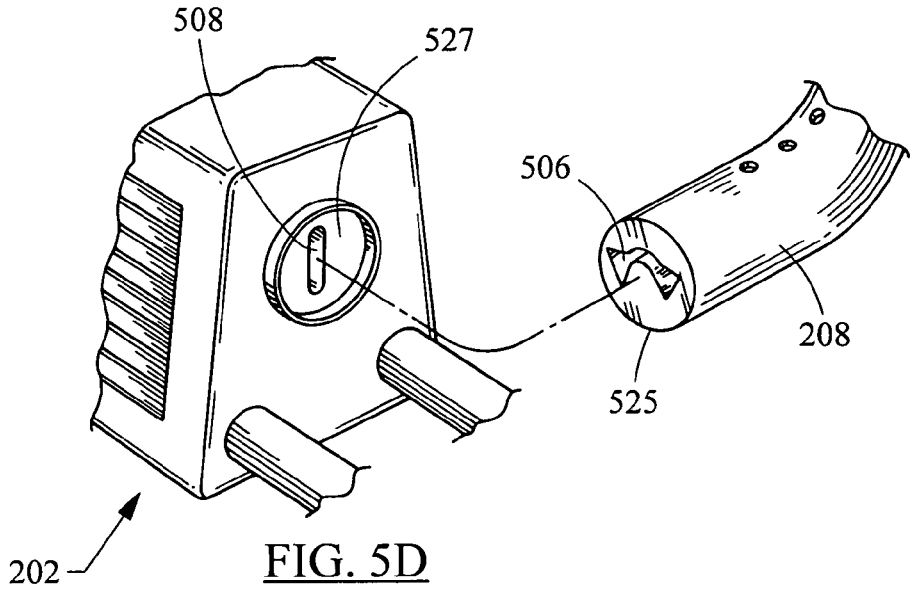
FIG. 5D illustrates a view of a flow control valve in one embodiment of a sprinkler according to the present invention.

The hourglass valve arrangement 500 may be placed in any of several locations in the water flow path in different embodiments of a sprinkler. FIG. 5D illustrates one way that the hourglass valve arrangement can be used in the sprinkler 200. In one embodiment, shown in FIG. 5D, the hourglass aperture 506 is located on the inlet end 525 of the spray tube 208, and the obround aperture 508 is located on an outlet surface 527 of the housing 202. In this embodiment, the hourglass aperture 506 will move back and forth relative to the obround aperture 508 as the spray tube 208 oscillatingly rotates during an operation of the sprinkler 200.

Figure 5E:
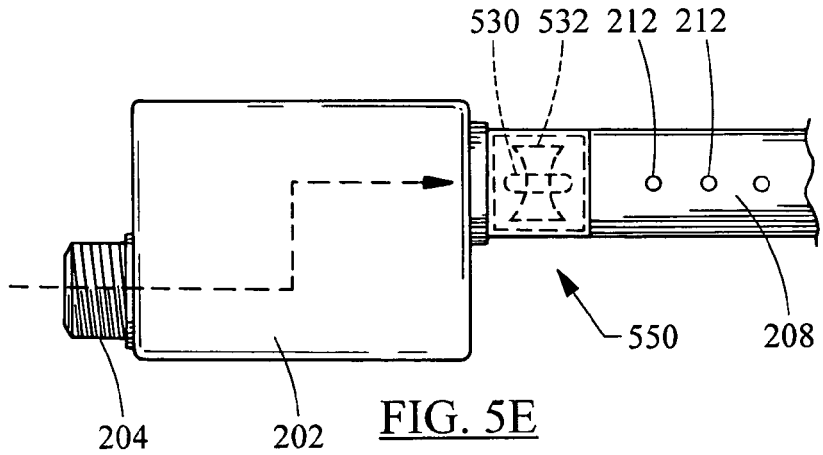
FIGS. 5E-5F depict a view of a flow control valve in another embodiment of a sprinkler according to the present invention.
Figure 5F:
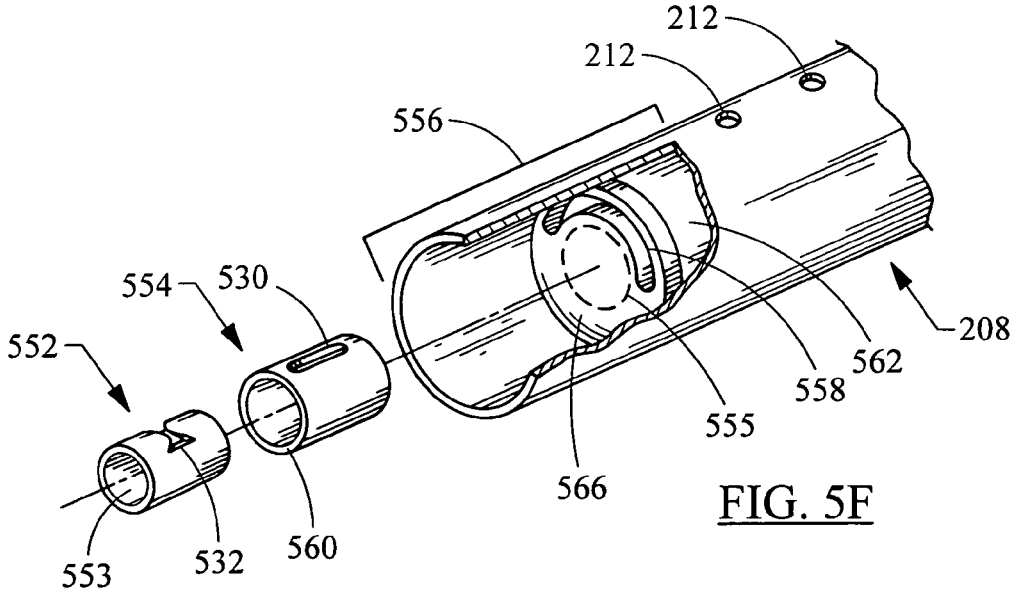

In another arrangement shown in FIGS. 5E-5F (also shown with reference to an exemplary sprinkler 200), a flow control assembly 550 is positioned at the end of the housing 202 in an inlet-end chamber 556 of the spray tube 208 of the sprinkler 200. The flow control assembly 550 restricts water flow near the middle of the watering cycle to achieve a water stream profile similar to that shown in FIG. 3.

FIG. 5E shows a diagrammatic top view of a portion of a sprinkler 200. Specifically, FIG. 5E shows an assembled view of the inlet 204, the housing 202, the flow control assembly 550, and the spray tube 208. FIG. 5F is a partially exploded and cutaway perspective view of the flow control assembly 550, and the spray tube 208. Internal components of the housing 202 are not shown. The flow control assembly 550 includes a tubular inner member 552, which incorporates an hourglass aperture 532. The inner member 552 is attached to the housing 202 such that it will not rotate when the spray tube 208 rotates. The inner member 552 includes an inlet lumen 553 that forms a water passage from the housing 202. The inner member 552 is annularly fitted inside a tubular outer member 554, which includes an elongate aperture 530. The outer member 554 is attached to the spray tube 208 (at a position indicated by a dotted line 555) such that the outer member 554 will move with the spray tube 208. Thus, when the spray tube 208 rotates, the outer member 554 rotates around the inner member 552.

The outermost part of the flow control assembly 550 comprises the inlet-end chamber 556 of the spray tube 208. The inlet-end chamber 556 is surrounded by a wall 560 of the spray tube 208. Thus, the assembled flow control assembly 550 includes a concentric arrangement: the inner member 552 is fitted inside the outer member 554, which is encircled by the annular space of the chamber 556 and the wall 560 that defines the circumference of the chamber 556. The inlet-end chamber 556 is separated from the water lumen 562 of the spray tube 208 by a divider 566. A spray tube inlet aperture 558 in the divider 566 provides fluid communication with the annular space. In operation, water enters the inlet 204, flows though the interior components of the housing 202, the inlet lumen 553 and the hourglass aperture 532 of the inner member 552, the elongate aperture 530 of the outer member 554, the annular space, the spray tube inlet aperture 558 of the divider 566, the spray tube water lumen 562, and finally through the nozzles 212.

Figure 6A:
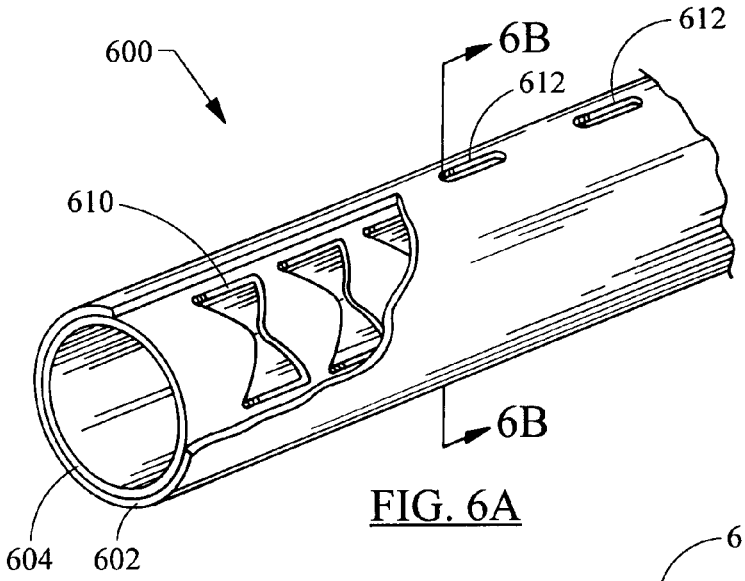
FIGS. 6A-6D show another embodiment of a flow control mechanism in a spray tube according to the present invention.
Figure 6B:
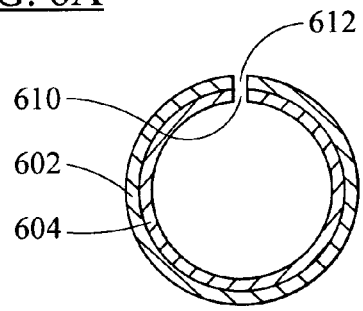
Figure 6C:
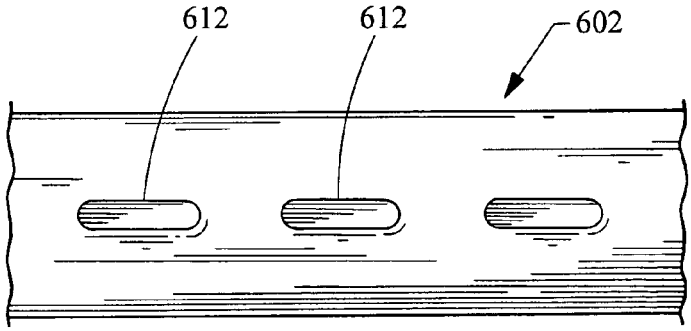
Figure 6D:
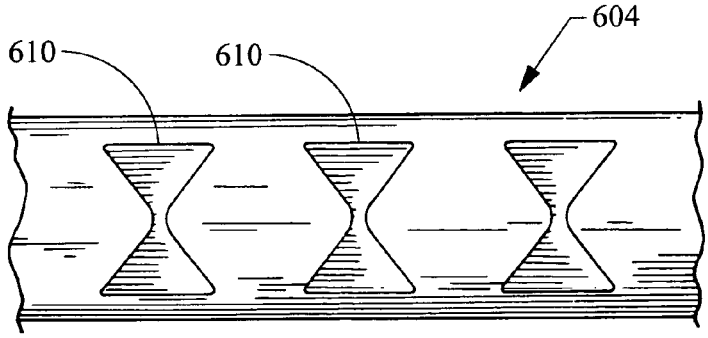

FIGS. 6A-6D depict another arrangement using hourglass-shaped openings 610 and elongate rounded nozzles 612 in a spray tube assembly 600. The spray tube assembly 600 is configured to provide a water stream profile similar to that shown in FIG. 3. FIG. 6A shows a partially cutaway perspective view of the spray tube assembly 600. FIG. 6B illustrates a cross-sectional view of the spray tube assembly 600 along line 6B-6B of FIG. 6A. The spray tube assembly 600 includes an outer tube 602 with a series of elongate rounded nozzles 612 and an inner tube 604 with a corresponding series of hourglass-shaped openings 610. FIG. 6C shows a portion of the outer tube 602, and FIG. 6D shows a portion of the inner tube 604. The outer tube 602 is rotatable relative to the inner tube 604. The inner tube 604 is annularly disposed inside the outer tube 602. Preferably there is a close tolerance between the inner and outer tubes 604, 602 to prevent water from leaking therebetween.

The inner tube 604 is non-rotatingly attached to the sprinkler housing (not shown), and the outer tube 602 is mounted with the ability to rotate about its longitudinal axis as it is propelled by a rotation mechanism (not shown). The elongate rounded nozzles 612 are positioned such that when—during a watering cycle—the outer tube 602 rotates relative to the inner tube 604, the elongate rounded nozzles 612 move across the varying widths of the hourglass-shaped openings 610 to control water flow as described above (with respect to FIGS. 5A-5C). Specifically, the water streams near each end of a watering cycle pass through the wider portions of the hourglass-shaped openings 610, allowing greater water flow. Therefore, the water streams near each end of the watering cycle are longer than the water streams near the middle of the watering cycle, where the water streams pass through the narrower portions of the hourglass-shaped openings 610. In an alternative embodiment, the annular positions of the outer and inner tubes 602, 604 may be reversed. In another alternative embodiment, the apertures of the inner tube 604 may be less hourglass-shaped near the ends of the tube 604, and more hourglass-shaped near the middle of the tube 604.

Figure 7A:
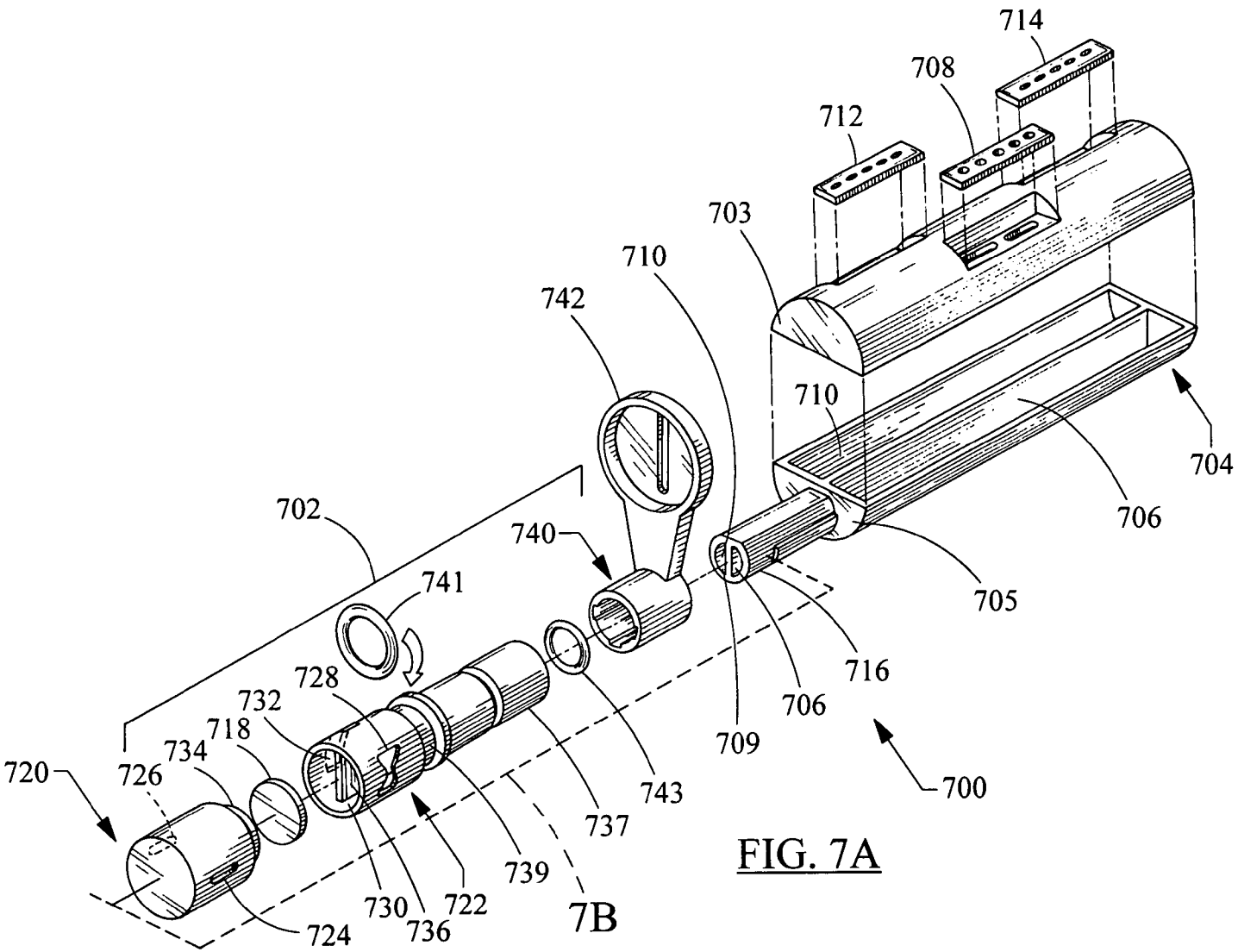

FIG. 7A shows an exploded, perspective view of one embodiment of a wind resistant sprinkler assembly 700 including a flow control assembly 702 and a dual lumen spray tube 704 (configured to be mounted to a sprinkler housing and base, not shown). FIG. 7B is a diagrammatic illustration of an assembled portion of the wind resistant sprinkler assembly 700, from a top view along a cross-sectional plane defined by phantom line bracket 7B. Most of the flow control assembly 702 is positioned in a sprinkler housing 699, with a portion extending out toward the spray tube 704. The wind resistant sprinkler assembly 700 provides for a water stream profile (as viewed from the end) similar to that shown in FIG. 3. Water flow is controlled separately for nozzles in the middle of the spray tube 704 and nozzles nearer the ends of the spray tube 704.

The dual lumen spray tube 704 is formed of an upper, nozzle-mounting component 703 and a lower flow path component 705. The spray tube 704 includes a first elongate lumen 706 directing water to a central nozzle set 708 and a second elongate lumen 710 directing water to proximal and distal end nozzle sets 712, 714. An inlet projection 716 extends proximally from the lower flow path component 705. The elongate lumens 706, 710 are separated by a wall 709 and extend through the inlet projection 716.

The openings of the proximal nozzle set 712 are angled in a proximal direction and the openings of the distal nozzle set 714 are angled in a distal direction, both relative to the longitudinal axis of the spray tube 704. The openings of the central nozzle set 708 are approximately vertical relative to the longitudinal axis of the spray tube 704. FIG. 7C depicts a side view of the water stream profile provided when the nozzle sets 708, 712, 714 are in the middle of a watering cycle, and oriented substantially vertically relative to the ground. (For illustration purposes, FIGS. 7C and 7E each include a sprinkler 785 incorporating the wind-resistant sprinkler assembly 700). In contrast with the arc-like side view of a water stream profile of prior art sprinklers as shown in FIG. 1B, the side view of the water stream profile in FIG. 7C is generally flatter across the top. The water streams from the central nozzle set 708 are reduced by the flow control assembly near the middle of each watering cycle, thereby shortening those central water streams (to keep them at or below a predetermined height indicated by a phantom line 775) and flattening the side-view water stream profile. Because of their angled configuration, the proximal and distal nozzle sets 712, 714 do not require a reduction of water flow to keep their water streams below the predetermined height, and the water flow to them is not varied substantially during each water cycle.

If all of the nozzle sets 708, 712, 714 had a restricted water flow near the middle of the watering cycle, the resulting watering area pattern (as viewed from the top) 791 would be narrower in the middle and wider at the ends, as shown in FIG. 7D. As is described below, the water flow to the central nozzle set 708 is controlled separately from the water flow to the proximal and distal nozzle sets 712, 714, using the two lumens of the spray tube 704. Because the sprinkler assembly 700 maintains a substantially consistent water flow to the proximal and distal nozzle sets 712, 714, the lengthwise sides of the watering area pattern are more linear. In addition, the controlled water flow at the ends of a watering cycle, provided by the tapered ends of the modified-hourglass-shaped port 728, may provide a flattened water stream profile of the central water streams nearer the ends of the watering cycle such that the overall watering area 793 more closely approximates a rectangle (see FIG. 7E).

The flow control assembly 702 includes a cup-shaped outer flow control member 720, an end cap 718, and an inner flow control member 722. The outer flow control member 720 has a solid proximal end and includes first and second slot ports 724, 726 disposed on its opposite lateral sides. The outer flow control member 720 mounts coaxially about a proximal portion of the inner flow control member 722.

The end cap 718 mounts sealingly into the proximal end of the inner flow control member 722. The inner flow control member 722 includes a modified-hourglass-shaped port 728 on one side, open to a first flow control lumen 730. The modified-hourglass-shaped port 728 is slightly tapered towards its ends. An oblong port 732 is located opposite the modified-hourglass-shaped port 728, and is open to a second flow control lumen 734. The first and second flow control lumens 730, 734 are separated by a divider 736 that fits sealingly against the end cap 718. A distal end portion 737 of the inner flow control member 722 fits around the inlet projection 716 of the spray tube 704.

The first flow control lumen 730 is aligned with and provides fluid communication to the first elongate lumen 706 of the spray tube 704, the second flow control lumen 734 is aligned with and provides fluid communication to the second elongate lumen 710 of the spray tube 704, and the distal end of the divider 736 is aligned with and fits against the wall 709 of the spray tube 704. A first o-ring 741 is disposed in a groove 739 around the inner flow control member 720, and provides a seal with the sprinkler housing 699. A second o-ring 743 disposed in the distal end portion 737 of the inner flow control member 722 provides a seal between it and the inlet projection 716 of the spray tube 704.

When the inner flow control member 722 is assembled into the outer flow control member 720, the first slot port 724 aligns with the modified-hourglass-shaped port 728 and the second slot port 726 aligns with the oblong port 732. During an operation of the sprinkler 700, water flows in a predetermined path through the sprinkler housing (not shown) and into the slot ports 724, 726. An oscillator mechanism attachment structure 740 mounts to the inlet projection 716, and an offset side protrusion 742 thereupon engages an oscillator mechanism (not shown) for transmitting rotational movement to the spray tube 704. Oscillator mechanisms not aligned longitudinally with the spray tube and using an offset side protrusion 742 of type shown in FIG. 7A (or an equivalent) are well-known in the art. In an alternative embodiment with an in-line transmission arrangement, the rotational movement is transmitted from an oscillator mechanism that is substantially aligned longitudinally with the spray tube. One example of such an in-line transmission arrangement is shown in U.S. Pat. No. 5,645,218, (owned by L.R. Nelson Corp. of Peoria, Ill.) which is incorporated herein by reference.

As the spray tube 704 rotates, the flow of the water through the junction of the first slot port 724 with the modified-hourglass-shaped port 728 is controlled in the same manner as described above with respect to FIGS. 5A-5C. This water flows to the central nozzle set 708 through the first flow control lumen 730 and the first elongate lumen 706, and provides a water stream profile from the central nozzle set 708 that is shorter toward the middle of a watering cycle, and longer toward the ends of the watering cycle. Preferably, the water stream profile from the central nozzle set 708 does not substantially exceed a predetermined height (which, as viewed from the end, preferably provides a water stream profile similar to that shown in FIG. 3). As the spray tube 704 rotates through a watering cycle, the flow of the water through the junction of the second slot port 726 with the oblong port 732, the second control lumen 734, the second elongate lumen 710, and the proximal and distal nozzle sets 712, 714 does not change substantially. Because the nozzles of the proximal and distal nozzle sets 712, 714 are angled, the water streams passing through them preferably will not substantially exceed the predetermined height 775 (see FIG. 7C).

In an alternative embodiment, a flow control mechanism such as one of those described above can be placed between the inlet and the oscillator mechanism that confers oscillatory rotation to the spray arm. In such an embodiment, the dwell time near the mid-point of oscillation in a watering cycle preferably is longer than at the ends because the water flow that impels the oscillator motor is less in the middle of the cycle, slowing the oscillating action of the motor.

FIGS. 8A-8D show another mechanism for varying the water flow to the nozzles during the oscillatory rotation of a spray tube 800 of an oscillating sprinkler. Similar to the embodiment depicted in FIGS. 7A-7B, the embodiment of FIGS. 8A-8D controls water flow to provide a desired water stream profile (as viewed from the end, similar to that shown in FIG. 3; as viewed from the side, similar to that shown in FIG. 7C). To provide that water stream profile, this embodiment uses a central cam member 802 to reduce water flow to certain nozzles of the spray tube 800 during a portion of each watering cycle.

Figure 8B:
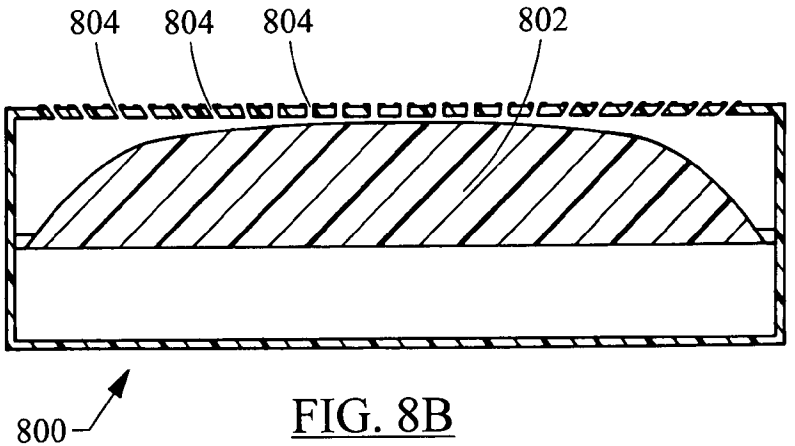
FIGS. 8A-8D illustrate an embodiment of a flow control mechanism in a spray tube according to the present invention.
Figure 8D:
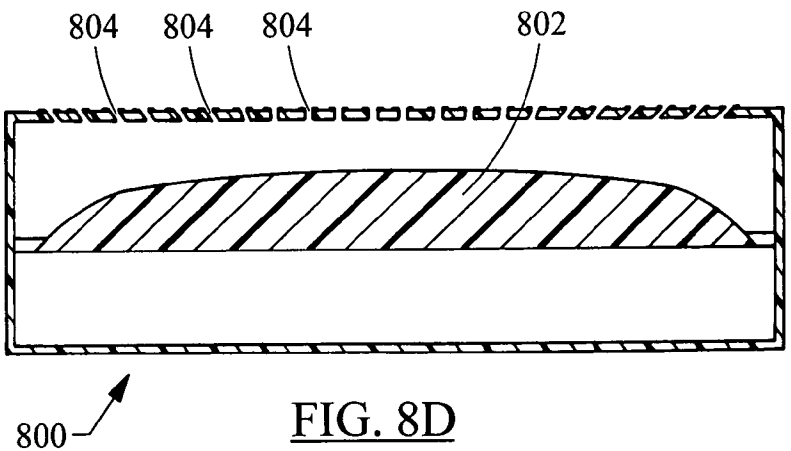
Figure 8A:
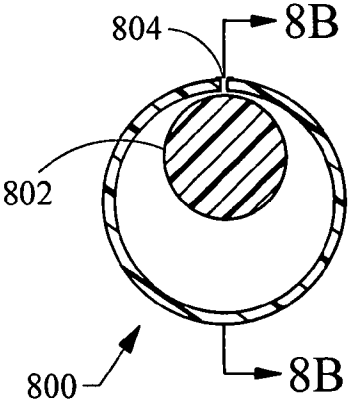

FIG. 8A illustrates a transverse cross-sectional view of the spray tube 800, which is rotatable by an oscillating mechanism of a sprinkler (not shown). The spray tube 800 houses the central rounded cam member 802, which does not rotate significantly with the spray tube 800. The surface of the cam member 802 is shaped to control the flow of water to the nozzles 804 of the spray tube 800. The water flow through the nozzles varies depending upon the amount of space between the surface of the cam 802 and the nozzle openings 804. FIG. 8B is a longitudinal sectional view of the spray tube 800 along line 8B-8B of FIG. 8A. When the nozzles 804 are substantially vertical, the surface of the cam member 802 is closest in proximity to the nozzles 804 near the center of the spray tube 800, resulting in a reduced water flow and reduced stream height from those nozzles 804.

Figure 8C:
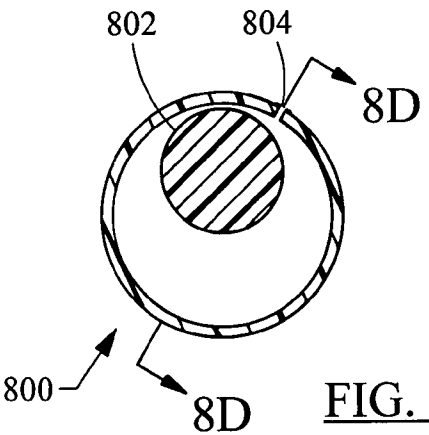

FIG. 8C, is a transverse cross-sectional view of the spray tube 800, and in FIG. 8D, is a longitudinal cross-sectional view along line 8D-8D of FIG. 8C. During a watering cycle, when the spray tube 800 rotates about its longitudinal axis such that the nozzles 804 are at about a 45 degree angle relative to the ground, the space between the surface of the cam member 802 and the nozzles 804 near the center of the spray tube increases. The increased space between the cam member 802 and the nozzles 804 allows the water flow to increase, lengthening the water streams. The ends of the surface of the cam 802 are not as near to the nozzles 804 as is the surface of the middle of the cam 802, so that the flow of water to and through the outer nozzles 804 is not substantially affected during a watering cycle rotation of the spray tube 800. The resulting water stream pattern preferably is similar to that shown in FIGS. 3 and 7C, and the watering area pattern preferably is similar to that shown in FIG. 7E.

Figure 9A:
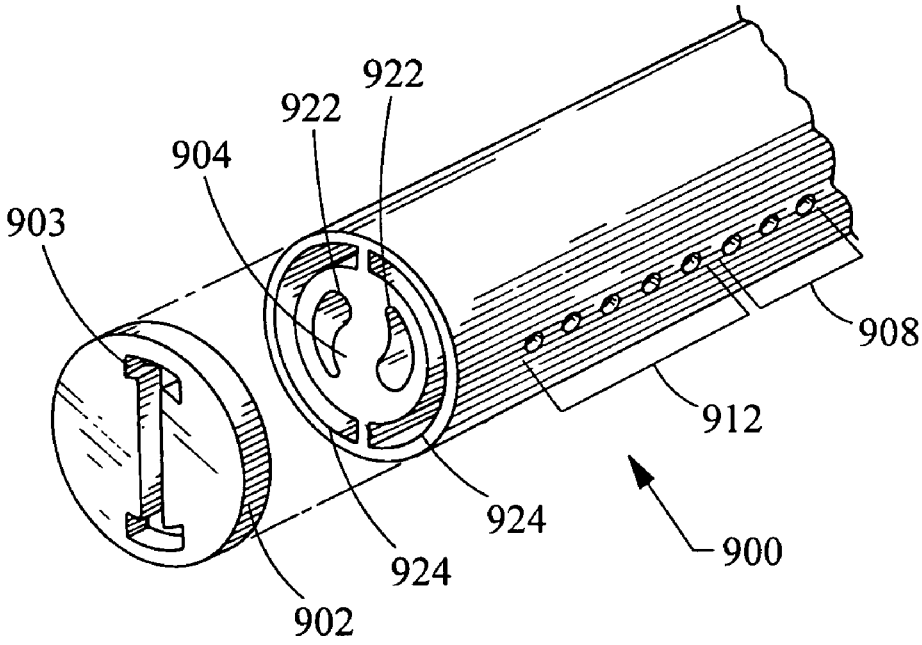
FIGS. 9A-9E depict another embodiment of flow control mechanism with a spray tube according to the present invention.
Figure 9B:
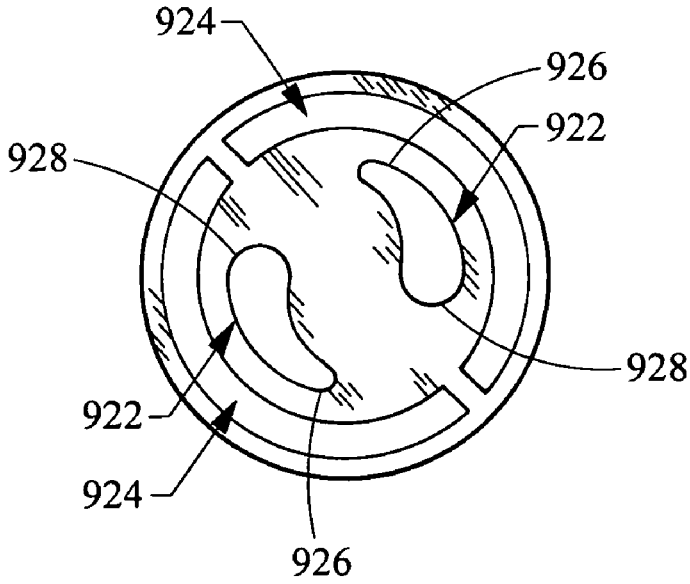
Figure 9C:
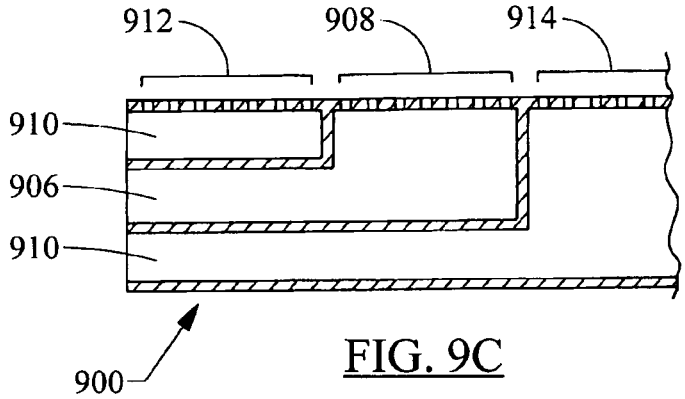

FIGS. 9A-9D show another embodiment of a flow control mechanism that controls water flow separately for central portion nozzles and for end portion nozzles to provide the desired water stream pattern (similar to that shown in FIGS. 3 and 7C). FIG. 9A depicts an exploded perspective view of a slotted flow controller component 902 and a dual lumen spray tube 900 including a multi-aperture flow controller component 904 in one embodiment of the present invention. The multi-aperture flow controller component 904 forms the proximal end surface of the spray tube 900. FIG. 9C illustrates a longitudinal cross-sectional view of the spray tube 900 and shows that the dual lumen spray tube 900 includes an inner lumen 906, which provides fluid communication from the multi-aperture flow controller component 904 to a central nozzle group 908. The spray tube 900 also includes an outer lumen 910 that provides fluid communication from the multi-aperture flow controller component 904 to the proximal and distal nozzle groups 912, 914 (see FIG. 9C). The spray tube 900 is configured to be rotatably mounted to a housing of an oscillating sprinkler that includes an oscillating mechanism (not shown) for rotating the spray tube 900. The slotted flow controller 902 is configured to be mounted non-rotatably. When the sprinkler is turned on, water passing through the housing to the nozzle groups 908, 912, 914 passes through a vertical slot 903 in the slotted flow controller 902 before going through the multi-aperture flow controller 904.

FIG. 9B shows a detail view of the proximal end of the multi-aperture flow controller component 904, which includes a pair of inner apertures 922. Each of the inner apertures 922 is a modified tear-drop shape including a narrower end portion 926, and a wider end portion 928. The inner apertures 922 provide fluid communication to the inner lumen 906 of the spray tube 900. The multi-aperture flow controller component 904 also includes a pair of outer apertures 924, which provide fluid communication to the outer lumen 910 of the spray tube 900.

Figure 9D:
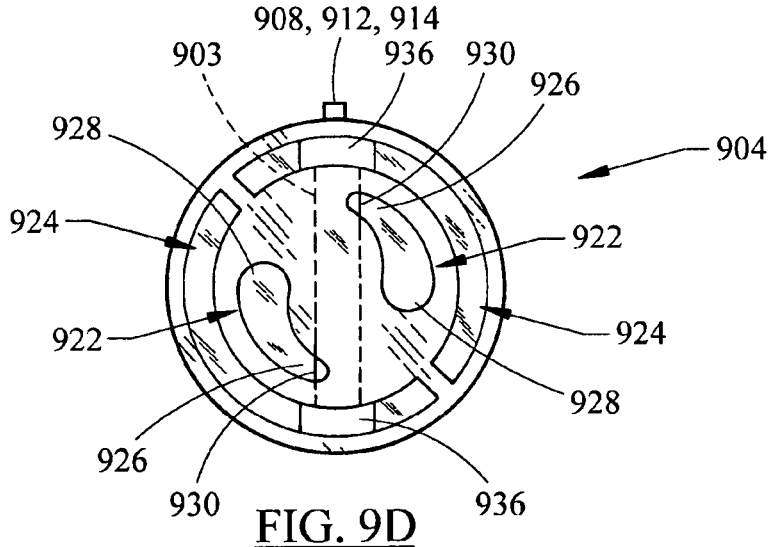
Figure 9E:
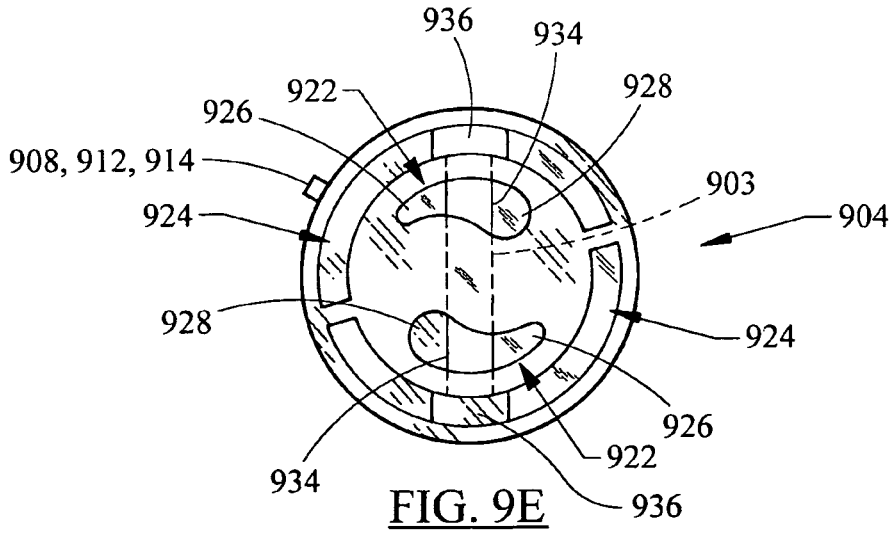

When the sprinkler is in operation and the spray tube 900 rotates relative to the slotted flow controller component 902, the area portion of the apertures 922 open to water flowing in through the slotted flow controller component 902 will change depending upon the angle of rotation. However, the overlapped area open from the slot 903 of the slotted aperture flow controller component 902 to the outer apertures 924 remains substantially the same, without regard for the angle of rotation during a watering cycle. This is indicated in FIGS. 9D-9E. Those of skill in the art will recognize that an alternative embodiment configured to vary the flow of water to the proximal and/or distal nozzle sets 912, 914 during a watering cycle is also within the scope of the present invention.

As is shown in FIG. 9D, when the nozzle groups 908, 912, 914 are substantially vertically oriented, the net flow aperture (the radial area of which is shown as shaded area 930) is smaller. The net flow aperture 930 to the inner lumen 906 and the central nozzles 908 is open though the slot 903 (shown in phantom lines) and the narrower end portions 926 of the inner apertures 922. The smaller net flow aperture 930 restricts water flow so that the vertical water streams are shorter, to provide the desired end-view water stream profile (see FIG. 3).

FIG. 9E illustrates that, when the nozzle groups 908, 912, 914 are oriented at about a 45 degree angle relative to the ground, the net flow aperture (the radial area of which is shown as shaded area 934) is larger. The net flow aperture to the inner lumen 906 and the central nozzles 908 is open through the slot 903 (shown in phantom lines) and the wider end portions 928 of the inner apertures 922. The larger net flow aperture 934 allows increased water flow to the nozzles, so that the angled water streams lengthen, providing the desired end-view water stream profile (see FIG. 3).

FIGS. 9D-9E also show that the radial area of the outer lumen net flow aperture (shown as shaded area 936) through the slot 903 (shown in phantom lines) into the outer lumen 910 does not change significantly throughout the rotation. Thus, the water flow to the outer nozzles 912, 914 does not change significantly during each watering cycle. Together with the effect provided by the inner apertures 922, this provides for a water stream profile, when the sprinkler is in operation, that preferably is similar to that illustrated in FIGS. 3 and 7C.

Figures 10A, 10B, 10C:
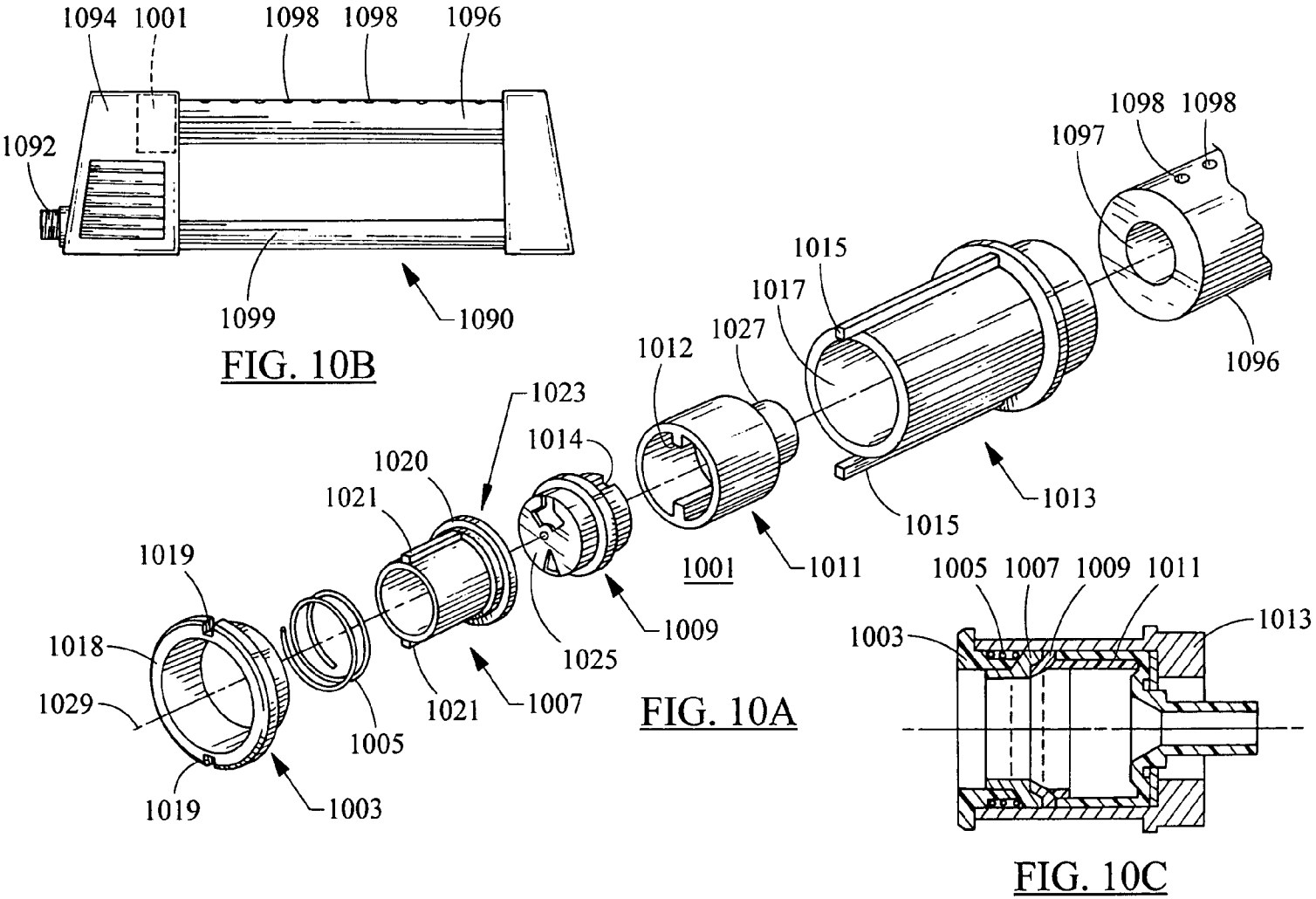
FIGS. 10A-10G illustrate yet another embodiment of a flow control mechanism according to the present invention.

FIGS. 10A-10G illustrate another (non-hourglass) shape for use in a flow controller that can be used to control water flow in an oscillating sprinkler, so as to confer an end-view watering profile similar to that shown in FIG. 3. FIG. 10A depicts an exploded perspective view of another embodiment of a flow controller mechanism 1001, which decreases water flow to the nozzles 1098 of a spray tube 1096 as they rotate nearer a vertical orientation. FIG. 10B is a diagrammatic side view of an oscillating sprinkler 1090 of the present invention including an inlet 1092, a housing 1094, a spray tube 1096 with nozzles 1098, and a base 1099. The flow controller mechanism 1001 (position indicated by shaded area) is disposed in the housing 1094 proximate the spray tube 1096.

As shown in FIG. 10A, the flow controller mechanism 1001 includes a proximal retaining cap 1003, a biasing spring 1005, a fixed spray pattern control unit 1007, a rotatable spray pattern control unit 1009, a spray tube attachment housing 1011, and a ribbed outer sleeve component 1013. The ribbed outer sleeve component 1013 includes a pair of ribs 1015 and a retaining lumen 1017. A proximal collar 1018 near the proximal end of the retaining cap 1003 includes a pair of notches 1019 that fit to the pair of ribs 1015.

FIG. 10C shows a longitudinal cross-sectional view of the flow controller mechanism 1001 as assembled. When the flow controller mechanism 1001 is assembled, the proximal retaining cap 1003 retains the biasing spring 1005, the fixed spray pattern control unit 1007, the rotatable spray pattern control unit 1009, and the spray tube attachment component 1011, in the retaining lumen 1017 of the ribbed outer sleeve component 1013. The pair of ribs 1015 engages the pair of notches 1019 such that the proximal retaining cap 1003 and the ribbed outer sleeve component 1013 will not substantially rotate relative to each other. To accomplish this, the pair of ribs 1015 is preferably welded, glued, or otherwise affixed to the pair of notches 1019.

The fixed spray pattern control unit 1007 includes a distal collar 1020 and a pair of longitudinal ribs 1021. The biasing spring 1005 is disposed between the proximal collar 1018 of the proximal retaining cap 1003 and the distal collar 1020 of the fixed spray pattern control unit 1007. The longitudinal ribs 1021 of the fixed spray pattern control unit 1007 engage the interior of the proximal retaining cap 1003 in a manner that allows longitudinal motion limited by the biasing spring 1005, but almost no rotational movement. The fixed spray pattern control unit 1007 has a distal face 1023 (not visible in FIG. 10A; see FIG. 10E) that fits against a proximal face 1025 of the rotatable spray pattern control unit 1009, and is biased against it by the biasing spring 1005.

The rotatable spray pattern control unit 1009 is affixed to the spray tube attachment component 1011, by engagement of a tooth 1012 with a gap 1014. The spray tube attachment component 1011 includes a distal projection 1027 that engages a central water chamber opening 1097 of the spray tube 1096. Thus, the rotatable spray pattern control unit 1009 and spray tube attachment component 1011 are mounted so as to rotate with the spray tube 1096. However, the proximal retaining cap 1003, the fixed spray pattern control unit 1007, and the ribbed outer sleeve component 1013 are mounted to each other and the sprinkler housing 1094 such that they will not rotate with the spray tube 1096.

In the embodiment pictured in FIGS. 10A-10G, the control of water flow to achieve the desired water stream profile (similar to that illustrated in FIG. 3) occurs at the junction of the distal face 1023 of the fixed spray pattern control unit 1007 with the proximal face 1025 of the rotatable spray pattern control unit 1009. The faces 1023, 1025 are shown in greater detail in FIGS. 10D-10E. A set of apertures in the faces 1023, 1025 control the flow of water from the sprinkler inlet 1092 to the spray tube 1098.

Figure 10D:
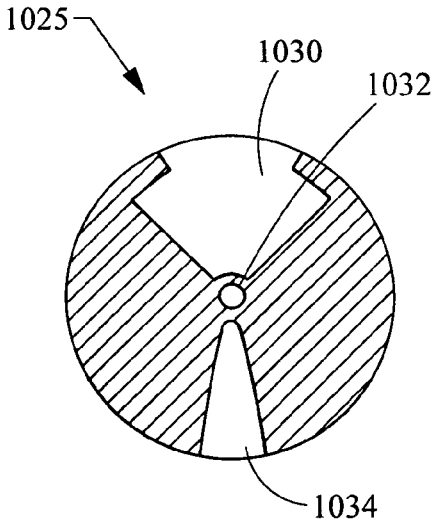
Figure 10E:
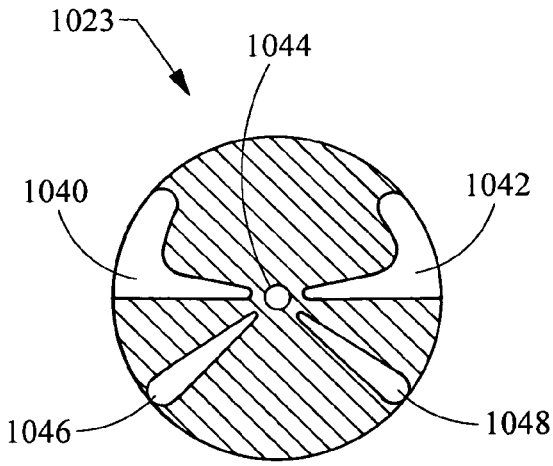

As shown in FIG. 10D, the proximal face 1025 of the rotatable spray pattern control unit 1009 includes a set of three apertures: a wider upper aperture 1030, a first round central aperture 1032, and a narrower lower aperture 1034. As shown in FIG. 10E, the distal face 1023 of the fixed spray pattern control unit 1007 includes a set of five apertures: first and second hooked upper apertures 1040, 1042, a second central round aperture 1044, and first and second elongate lower apertures 1046, 1048. Water flow from the sprinkler's inlet 1092 to the spray tube 1096 is limited by the overlap area of the two sets of apertures. Broken line 1029 in FIG. 10A shows the alignment of the above-described components as well as a path of water flow through them.

Figure 10F:
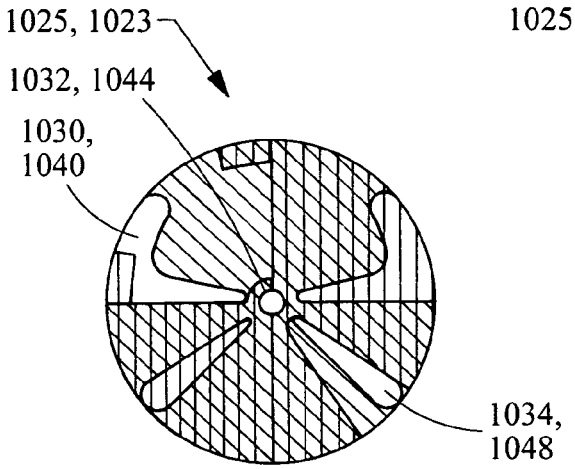
Figure 10G:
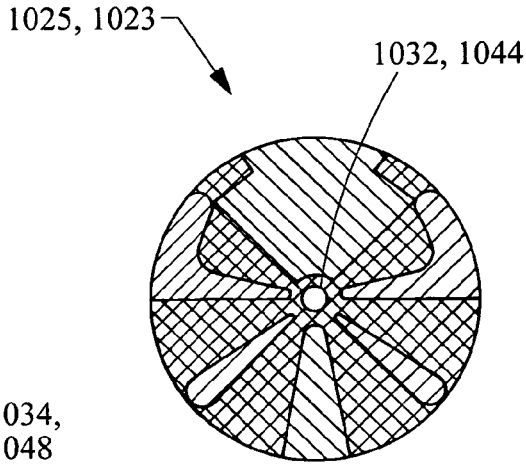

When the rotatable spray pattern control unit 1009 is assembled into the flow controller mechanism 1001 and attached to the spray tube 1096, its narrower lower aperture 1034 is aligned 180 degrees opposite the nozzles 1098 on the spray tube 1096. When the rotatable spray pattern control unit 1009 rotates with the spray tube 1096, the combined area open through the two sets of apertures (in the spray pattern control units 1007, 1009) changes to control the water flow and the resulting stream pattern. FIGS. 10F-10G illustrate how the overlapping sets of apertures interact to control water flow. Cross-hatching on the solid portions of the faces 1023, 1025 is used in FIGS. 10F-10G to indicate the areas covered by a solid surface, including where the solid surfaces overlap, and the absence of cross-hatching is used to indicate areas open to water flow.

FIG. 10F depicts the relative positions of the fixed and rotatable spray pattern control units 1007, 1009 when the spray tube 1096 and the rotatable spray pattern control unit 1009, with its face 1025 are rotated counterclockwise, such that the sprinkler nozzles 1098 are oriented about 45 degrees from vertical. (This is the "maximum flow" position, wherein the profile of water streams dispensed from the nozzles 1098 preferably will approximate that of the water streams 302*c* shown in FIG. 3.) The second central round aperture 1044 of the fixed spray pattern control unit 1007 is substantially aligned with the first round central aperture 1032 of the rotatable spray pattern control unit 1009. A substantial portion of the wider upper aperture 1030 is aligned with the first hooked upper aperture 1040, and a portion of the narrower lower aperture 1034 is aligned with the second elongate lower aperture 1048. This alignment provides a larger combined/net aperture (1030+1040, 1032+1044, and 1034+1048), which allows a corresponding greater water flow to the spray tube 1096. Clockwise rotation of the rotatable spray pattern control unit 1009 by 45 degrees from vertical provides substantially the same combined net aperture area as shown in FIG. 10F, and the overlapped faces 1023, 1025 will form substantially a mirror image of FIG. 10F.

FIG. 10G depicts the relative positions of the fixed and rotatable spray pattern control units 1007, 1009 when the sprinkler nozzles 1098 are oriented substantially vertically. (This is the "minimum flow" position, wherein the profile of water streams dispensed from the nozzles 1098 preferably will approximate that of the water streams 302*a* shown in FIG. 3.) The second central round aperture 1044 of the fixed spray pattern control unit 1007 is substantially aligned with the first round central aperture 1032 of the rotatable spray pattern control unit 1009. The combined, overlapped aperture (1032+1044) provides the only significant water passage to the spray tube 1096, restricting water flow and thereby providing for shorter water streams while the nozzles 1096 are vertical.

In another aspect the present invention includes a method for reducing the height of water streams from an oscillating sprinkler. The method may be understood with reference to several of the above-described embodiments, but is herein described with reference to FIG. 2, without being limited thereby. The method includes providing a series of nozzles 212 configured to rotate about a longitudinal axis parallel to the series of nozzles 212. The method further includes rotating the series of nozzles 212 about the longitudinal axis and supplying water to the series of nozzles 212 at a first flow rate when the series of nozzles 212 is substantially vertically oriented with respect to a ground surface. The method still further includes supplying water to the series of nozzles 212 at a second flow rate when the series of nozzles 212 is not substantially vertically oriented with respect to the ground surface. The second flow rate is greater than the first flow rate. Preferably, as the series of nozzles 212 rotates, they dispense water streams in a profile that, viewed from an end, approximates the water stream profile illustrated in FIG. 3. More preferably, as the series of nozzles 212 rotates, the profile of water streams, as viewed from the side, approximates the water stream profile illustrated in FIG. 7C.

It will be apparent to those skilled in the art that various alternative mechanisms, including other valve shapes, can be employed for varying the water flow to the nozzles during the stroke of the arm without departing from the spirit or scope of the invention. It will also be apparent to those skilled in the art that various modifications, combination, and variations can be made in the illustrated and described embodiments of the present invention without departing from the spirit or scope of the invention. It is therefore intended that the foregoing detailed description be regarded as illustrative rather than limiting, and that it be understood that it is the following claims, including all equivalents, modifications, combinations, and variations that are intended to define the spirit and scope of this invention.

We claim:

1. An oscillating water sprinkler, comprising:

a spray structure having a plurality of outlets;

a support structure which supports said spray structure, said spray structure being movable in relation to said support structure in an oscillating pattern of movement;

an inlet supported by said support structure and configured to be coupled to a hose; and a valve mechanism interposed between said inlet and said plurality of outlets, said valve mechanism defining a water flow aperture providing fluid communication between said inlet and said plurality of outlets, wherein, during said oscillating pattern of movement, said spray structure oscillates in relation to said support structure between a first position and a second position, wherein, as said spray structure moves between said first position and said second position during said oscillating pattern of movement, said support structure passes through a central position, and wherein, as said spray structure moves from said central position to one of said first position and said second position during said oscillating pattern of movement, (i) said water flow aperture increases in size, and (ii) said water flow aperture never decreases in size.

2. The oscillating water sprinkler of claim 1, wherein said spray structure includes a spray tube defining said plurality of outlets.

3. The oscillating water sprinkler of claim 1, wherein said valve mechanism includes:

a first valve component attached in fixed relation to said support structure, said first valve component defining a first aperture, a second valve component attached in fixed relation to said spray structure, said second valve component defining a second aperture, and said first valve component is positioned adjacent to said second valve component such that said first aperture is at least partially aligned with said second aperture to collectively define said water flow aperture.

4. The oscillating water sprinkler of claim 3, wherein said second valve component moves in relation to said first valve component during movement of said spray structure between said first position and said second position.

5. The oscillating water sprinkler of claim 1, wherein:

said water flow aperture possesses a first size when said spray structure is positioned at one of said first position and said second position, said water flow aperture possesses a second size when said spray structure is positioned at said central position, and said first size is larger than said second size.

6. The oscillating water sprinkler of claim 1, wherein:

said spray structure also has a supplement group of outlets, said spray structure defines (i) a first lumen that is in fluid communication with said plurality of outlets, and (ii) a second lumen that is in fluid communication with said supplemental group of outlets, said valve mechanism includes a first valve component attached in fixed relation to said spray structure, said first valve component defining (i) a first aperture that is in fluid communication with said first lumen, and (ii) a second aperture that is in fluid communication with said second lumen, said valve mechanism further includes a second valve component attached in fixed relation to said support structure, said second valve component defining a third aperture, said first valve component is positioned adjacent to said second valve component such that (i) said first aperture is at least partially aligned with said third aperture to collectively define said water flow aperture, and (ii) said second aperture is at least partially aligned with said third aperture to collectively define a secondary flow aperture, said water flow aperture provides fluid communication between said inlet and said first lumen, and said secondary flow aperture provides fluid communication between said inlet and said second lumen.

7. The oscillating water sprinkler of claim 6, wherein:

said water flow aperture possesses a first size when said spray structure is positioned at one of said first position and said second position, said water flow aperture possesses a second size when said spray structure is positioned at said central position, and said first size is larger than said second size.

8. The oscillating water sprinkler of claim 7, wherein:

said secondary flow aperture possesses a first area when said spray structure is positioned at one of said first position and said second position, said secondary flow aperture possesses a second area when said spray structure is positioned at said central position, and said first area is substantially the same as the second area.

9. The oscillating water sprinkler of claim 1, wherein said spray structure is configured to advance water through said plurality of outlets in a substantially vertical direction when said spray structure is positioned at said central position.

10. The oscillating water sprinkler of claim 1, wherein, during movement of said spray structure from said central position to one of said first position and said second position, said water flow aperture continuously increases in size.

11. An oscillating water sprinkler, comprising:

a spray structure having a plurality of outlets;

a support structure which supports said spray structure, said spray structure being movable in relation to said support structure in an oscillating pattern of movement;

an inlet supported by said support structure and configured to be coupled to a hose; and a valve mechanism interposed between said inlet and said plurality of outlets, said valve mechanism defining a water flow aperture providing fluid communication between said inlet and said plurality of outlets, wherein, during said oscillating pattern of movement, said spray structure oscillates in relation to said support structure between a first position and a second position, wherein, as said spray structure moves between said first position and said second position during said oscillating pattern of movement, said support structure passes through a central position, wherein, as said spray structure moves from said central position to said first position during said oscillating pattern of movement, (i) said water flow aperture increases in size, and (ii) said water flow aperture never decreases in size, and wherein, as said spray structure moves from said central position to said second position during said oscillating pattern of movement, (i) said water flow aperture increases in size, and (ii) said water flow aperture never decreases in size.

12. The oscillating water sprinkler of claim 11, wherein said spray structure includes a spray tube defining said plurality of outlets.

13. The oscillating water sprinkler of claim 11, wherein said valve mechanism includes:

a first valve component attached in fixed relation to said support structure, said first valve component defining a first aperture, a second valve component attached in fixed relation to said spray structure, said second valve component defining a second aperture, and said first valve component is positioned adjacent to said second valve component such that said first aperture is at least partially aligned with said second aperture to collectively define said water flow aperture.

14. The oscillating water sprinkler of claim 13, wherein said second valve component moves in relation to said first valve component during movement of said spray structure between said first position and said second position.

15. The oscillating water sprinkler of claim 11, wherein:

said water flow aperture possesses a first size when said spray structure is positioned at said first position, said water flow aperture possesses said first size when said spray structure is positioned at said second position, said water flow aperture possesses a second size when said spray structure is positioned at said central position, and said first size is larger than said second size.

16. The oscillating water sprinkler of claim 11, wherein:

said spray structure also has a supplement group of outlets, said spray structure defines (i) a first lumen that is in fluid communication with said plurality of outlets, and (ii) a second lumen that is in fluid communication with said supplemental group of outlets, said valve mechanism includes a first valve component attached in fixed relation to said spray structure, said first valve component defining (i) a first aperture that is in fluid communication with said first lumen, and (ii) a second aperture that is in fluid communication with said second lumen, said valve mechanism further includes a second valve component attached in fixed relation to said support structure, said second valve component defining a third aperture, said first valve component is positioned adjacent to said second valve component such that (i) said first aperture is at least partially aligned with said third aperture to collectively define said water flow aperture, and (ii) said second aperture is at least partially aligned with said third aperture to collectively define a secondary flow aperture, said water flow aperture provides fluid communication between said inlet and said first lumen, and said secondary flow aperture provides fluid communication between said inlet and said second lumen.

17. The oscillating water sprinkler of claim 16, wherein:

said water flow aperture possesses a first size when said spray structure is positioned at said first position, said water flow aperture possesses said first size when said spray structure is positioned at said second position, said water flow aperture possesses a second size when said spray structure is positioned at said central position, and said first size is larger than said second size.

18. The oscillating water sprinkler of claim 17, wherein:

said secondary flow aperture possesses a first area when said spray structure is positioned at said first position, said secondary flow aperture possesses said first area when said spray structure is positioned at said second position, said secondary flow aperture possesses a second area when said spray structure is positioned at said central position, and said first area is substantially the same as the second area.

19. The oscillating water sprinkler of claim 11, wherein said spray structure is configured to advance water through said plurality of outlets in a substantially vertical direction when said spray structure is positioned at said central position.

20. The oscillating water sprinkler of claim 11, wherein:

during movement of said spray structure from said central position to said first position, said water flow aperture continuously increases in size, and during movement of said spray structure from said central position to said second position, said water flow aperture continuously increases in size.

* * * * *